United States Patent [19]

Hirooka et al.

[11] Patent Number: 4,554,805

[45] Date of Patent: Nov. 26, 1985

[54] AGITATING TYPE WASHING MACHINE

[75] Inventors: Hiroshi Hirooka, Tokyo; Yoshio Yoshida, Ayase; Toshio Fukushi, Hiratsuka; Yasuo Takeya, Yokohama; Satoshi Nagai, Fujisawa, all of Japan

[73] Assignee: Kaisha, Kentetsuco., Ltd., Tokyo, Japan

[21] Appl. No.: 581,155

[22] Filed: Feb. 17, 1984

[30] Foreign Application Priority Data

Feb. 21, 1983 [JP] Japan ..... 58-27458
Feb. 21, 1983 [JP] Japan ..... 58-27459

[51] Int. Cl.[4] ..... D06F 17/08; D06F 33/02

[52] U.S. Cl. ..... 68/12 R; 68/133; 318/282

[58] Field of Search ..... 68/12 R, 131, 133; 318/280, 281, 282, 286

[56] References Cited

U.S. PATENT DOCUMENTS 3,369,381 2/1968 Crane et al. ..... 68/12 R
4,335,592 6/1982 Torita ..... 68/12 R

FOREIGN PATENT DOCUMENTS 137865 10/1979 Japan ..... 68/12 R

*Primary Examiner*—Philip R. Coe
*Attorney, Agent, or Firm*—Armstrong, Nikaido, Marmelstein & Kubovcik

[57] ABSTRACT

In an agitating type washing machine a washing drive motor is run reciprocally in opposite directions to rotate an agitating wheel within a washing tank alternately in one and the other directions to perform intended washing. The washing machine comprises a rotational angle detector for detecting an angle of rotation of the agitating wheel, and a control for controlling the motor in response to a detection signal from the rotational angle detector. The control controls such that an angle of rotation of said agitating wheel by energization of the motor during running under a load is made smaller than that during no load running and that changing over between running under a load and no load running is automatically effected in response to a detection signal from the rotational angle detector, and controls rotation of said agitating wheel to an angle equal to or less than 360 degrees including rotation by energization of the motor and rotation by inertia whether during running under a load or no load.

4 Claims, 15 Drawing Figures

START

200
F1=1
201
F2=1
202
Rotation angle under no load (the number of pulses N1) is set.
203
X1 ← N1
204
Rotation angle under a load (the number of pulses N2) is set.
205
X2 ← X2
206
F1=1
Y
N
207
Motor is rotated counterclockwise.
208
Motor is rotated clockwise.
Motor is deenergized.
T ← T+1
209
213
210
F1=1
Y
N
211
214
T←T+1
Y
T≧X2
N
212
Y
T≧X1
N
Y
N
215
Has agitating wheel stopped ?
T≧X2
Y
N
216
T=0
221
217
F1=0
Y
F2=1
218
N
219
F2=0
F1=1
220

AGITATING TYPE WASHING MACHINE

BACKGROUND OF THE INVENTION

This invention relates to an agitating type washing machine in which an agitating wheel is driven to operate reciprocally in opposite directions by a drive motor.

In an agitating type washing machine, an agitating wheel disposed in the center on a bottom of the machine is reciprocally rotated within a predetermined angle to effect intended washing operations, as widely known in the art. Conventionally, in order to effect such a reciprocal motion, such an agitating type washing machine includes a gearing, a link mechanism, and so on, by way of which rotation of a motor is transmitted to an agitating wheel. Thus, an agitating type washing machine is applicable particularly to a large volume washing machine. However, since a mechanism for producing a reciprocal motion therein is complicated and is thus expensive in cost, it is difficult to employ such a mechanism for a small washing machine.

In recent years, in order to introduce an agitating type into a small washing machine, an agitating type washing machine has been proposed in which a motor is directly controlled to run in opposite directions using a timer and so on to reciprocally rotate an agitating wheel. This system only necessitates control of duration of energization of a motor and thus can be produced advantageously at a low cost. However, it is disadvantageous in that reciprocal angular rotations of an agitating wheel will not be held constant depending upon variations in an amount of the washing, a voltage of a power supply, and so on, thus preventing sufficient performance of functions inherent to the agitating type.

In particular, since this system is a timing controlling system which utilizes a timer, an interval of time from interruption of energization of a motor to actual stopping thereof is long when the machine is run either without a load, that is, without any washing, or with a little washing. On the contrary, when the machine has a large amount of washing to wash, such washing acts to brake the motor and hence the motor is stopped in a reduced interval of time. Accordingly, if an interval of time required to stop a motor of the machine is determined for no load running of the machine which provides a maximum interval of time for stopping, then when there is a large amount of washing, some wasteful time will appear before the machine is run in the opposite direction after deenergization of the motor, resulting in deterioration in efficiency of washing. Further, since durations of energization of a motor are held constant, angular rotation of an agitating wheel will be large when there is a little washing, but on the contrary, when the machine has a large amount of washing, angular rotation of the agitating wheel will be small. Thus, the system is disadvantageous in that it presents characteristics which are reverse to those required for such a washing machine. Accordingly, if it is intended, in such conditions, to wash a given amount of washing, then when there is no water in a washing tank, that is, upon no load running of the machine, the agitating wheel may rotate in several rotations and thus there may possibly be a danger of a hand of a man or the like being caught by the agitating wheel. A system has also been proposed in which a plurality of water flows are determined in prior in accordance of amounts of washing and one of such water flows may be selected by means of a push button switch or the like each time the machine is used, in order to prevent damage. But, in this system, the amount of washing must be measured accurately each time the machine is used. Furthermore, such measurement is troublesome and results in insufficient attainment of performance of the washing machine. Besides, it is also disadvantageous in that, if an operator inadvertently forgot to selectively set a water flow, the clothing might be damaged.

A further system has also been proposed in which a number of controlled time intervals are provided in accordance with amounts of washing and are changed over to wash a given amount of washing. But, this system is also disadvantageous in that it is accompanied by a complicated control.

SUMMARY OF THE INVENTION

The present invention has thus been made in consideration of the circumstances as described above.

It is an object of the invention to provide an agitating type washing machine which can be controlled to attain a constant or uniform angle of reciprocal rotation of an agitating wheel to improve reliability of washing performances of the machine.

It is a further object of the invention to provide an agitating type washing machine wherein two different angles of rotation of an agitating wheel for no load running and running under a load, which are both equal to or less than 360 degrees, are set in prior to washing means of a controller composed of an operating processing device, a memory, and so on, which are automatically changed over for no load running and for running under a load in response to an angle signal for detecting an angle of rotation of the agitating wheel. The motor is reversed after the agitating wheel has been stopped so that an angle of rotation of the agitating wheel which moves by inertia is made relatively large when there is a small amount of articles to be washed whereas such an angle is made relatively small when there is a large amount of articles to be washed. The period of time for a reciprocal motion of the agitating wheel is varied depending upon the amount of articles to be washed so that the optimum number of reciprocal motions may be automatically set.

DETAILED DESCRIPTION OF THE EMBODIMENTS

Figure 1:
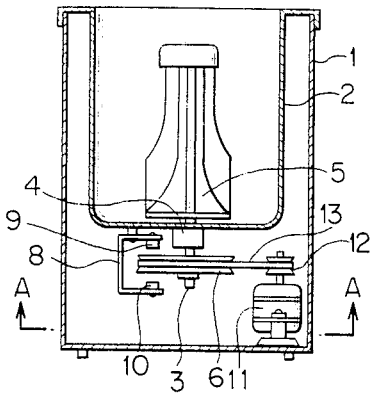
FIG. 1 is a sectional view showing an embodiment of an agitating type washing machine of the present invention.
Figure 2:
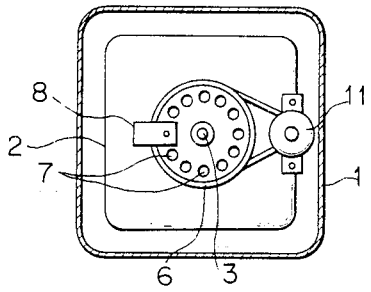
FIG. 2 is a sectional view taken along the line A—A of the FIG. 1.

An embodiment of the present invention will now be described with reference to the accompanying drawings. Referring to FIGS. 1 and 2 a washing tank 2 is secured within the outer housing 1 of a washing machine and articles are washed in the washing tank 2. A main shaft 3 is mounted water-tight at the center of a bottom of the washing tank 2 and is supported for rotation by means of a main shaft bearing 4. An agitating wheel 5 is mounted on the main shaft 3 within the washing tank 2, and a pulley 6 is mounted at a bottom end of the main shaft 3 and has a plurality of detection holes 7 for detection of a rotational angle of the agitating wheel 5 perforated in a predetermined spaced relationship along a circular line therein (FIG. 2). A rotational angle detector 8 includes a light emitter 9 and a light receiver 10. Light receiver 10 receives, at a position of a detection hole 7 of the pulley 6, a beam of light projected from the emitter 9 and produces the number of pulse signals corresponding to an angle of rotation of the pulley 6 and hence an angle of rotation of the agitating wheel 5. A washing machine drive motor 11 is mounted on the bottom in the outer housing 1. Another pulley 12 is mounted on the motor 11. A belt 13 interconnects the pulleys 6 and 12. Rotation of the motor 11 is thus transmitted to the agitating wheel 5 by way of the pulleys 6 and 12 and the belt 13.

Figure 3:
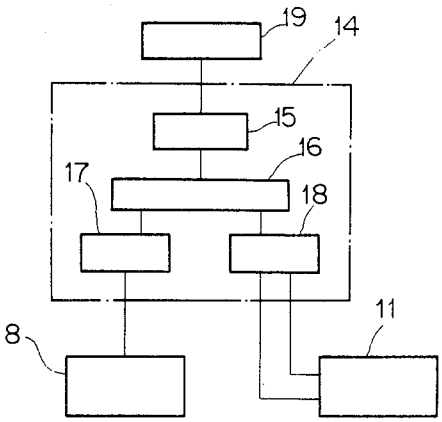
FIG. 3 is a schematic diagram showing a control system for the arrangement of FIG. 1.

FIG. 3 shows a control system for the arrangement of FIGS. 1 and 2 control circuit 14 includes a memory 15, an operating processing device 16, an input control 17 and an output control 18. A power source is connected to the control circuit 14 by way of a switch 19. Detection signals representative of an angle of rotation of the agitating wheel 15 detected by the rotational angle detector 8 are inputted to the control circuit 14 through the input control 17 and are operated and processed by the memory 15 and the operating processing device 16. A signal produced as a result of such processing is applied as a control signal to the motor 11 through the output control 18 so as to rotate the motor 11 in a clockwise or counterclockwise direction in accordance with the output signal.

Figure 4:
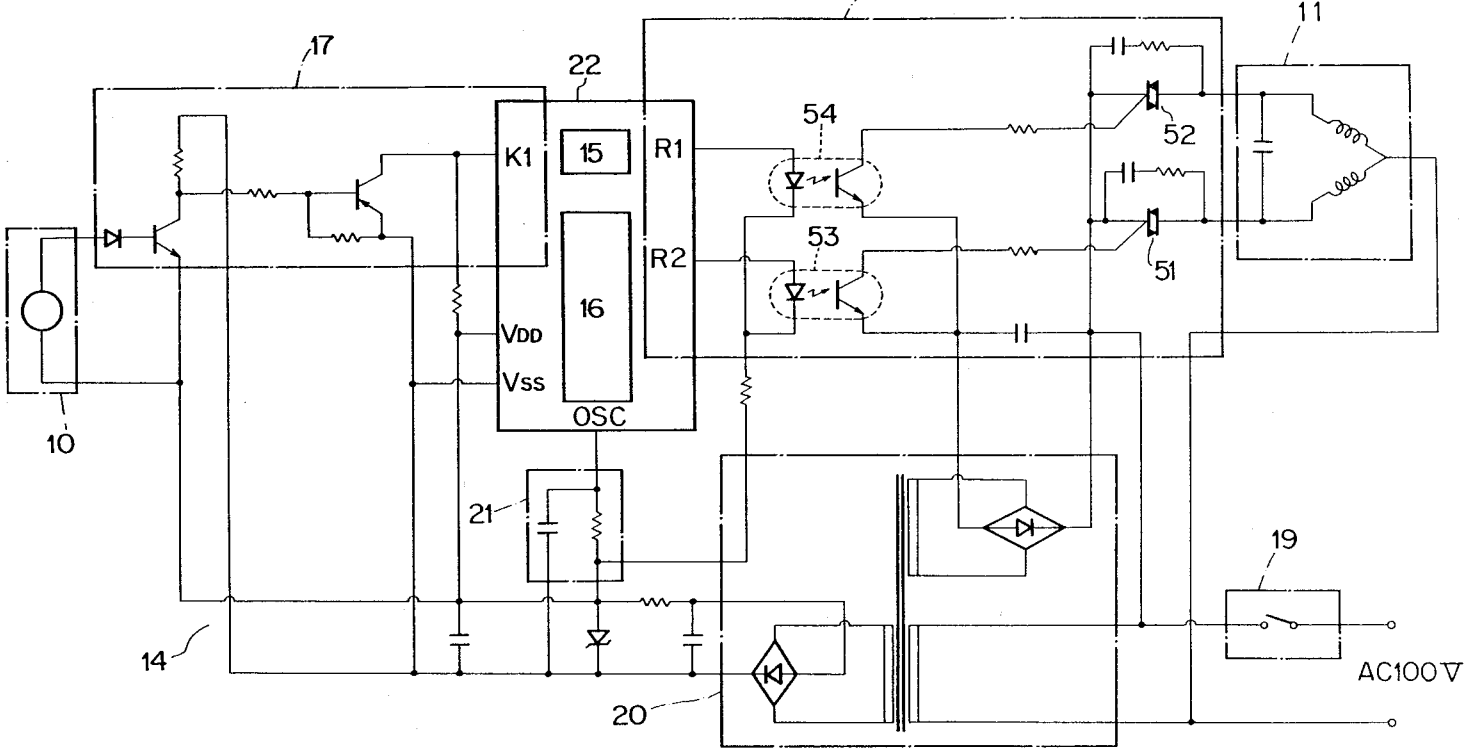
FIG. 4 is a circuit diagram showing the details of the control system of FIG. 3.

FIG. 4 shows the details of the circuit of FIG. 3. The reference numeral 19 designates a power switch; 20 a d.c. power for a gate power of thyristors 51 and 52 which turn on or off the clockwise and counterclockwise rotation of the motor 11 respectively and a drive power for a microcomputer 22 having a memory 15 and an operation processor 16 within the control circuit 14; 21 a clock generator which produces reference clock time for the microcomputer 22; 17 an input controller. The input controller converts the sinusoidal electric output which is generated from the rotation detector 10 in synchrorism with the rotation into pulse like electric output and then applies it to an input port $K_1$ of the microcomputer. Reference numeral 18 designates an output controller including photocouplers 53 and 54 and the thyristors 51 and 52 which control the turn-on or turn-off of the clockwise and counterclockwise rotation of the motor 11 in response to signals from output ports $R_1$ and $R_2$ of the microcomputer.

Figure 5:
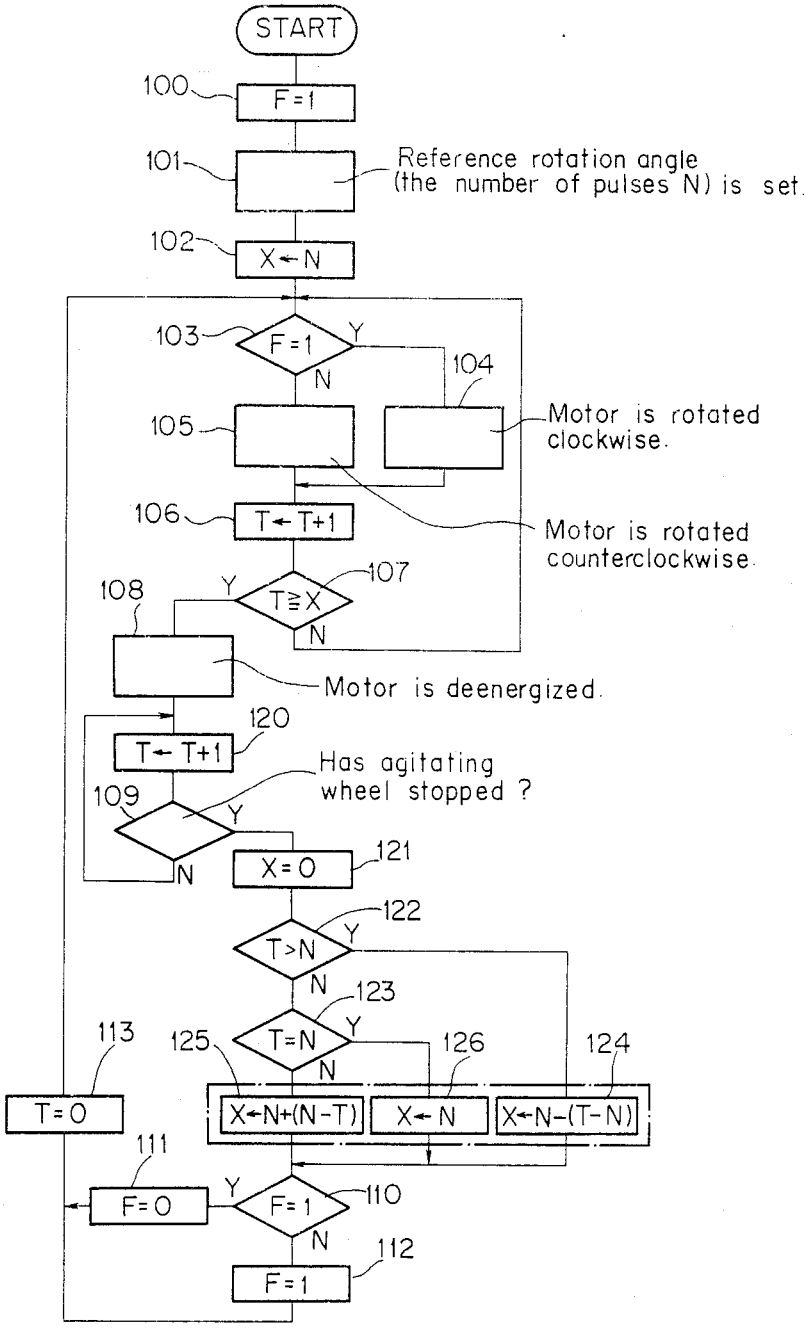
FIG. 5 is a flow chart showing the operation of the arrangement of FIG. 1 and particularly of the control system of FIG. 3.

FIG. 5 is a flow chart which indicates operations of the arrangement and particularly of the control system thereof as described above. Step 100 is a rotational direction flag setting step at which a flag is set which represents a running direction of the motor 11, and next step 101 is a rotational angle setting step for setting an angle of rotation of the agitating wheel 5 (an angle over which the motor is energized). Thus, at step 101, the number of pulses N corresponding to an angle of rotation is set, and this value is stored in a register X at next step 102. Subsequent step 103 is a rotat direction discriminating step for discriminating between rotational direction of the motor 11. Step 106 is a counter step for counting the angle of rotation of the agitating wheel 5 (the number of pulses from the rotational angle detector 8). The count is inputted to a register T. Step 107 is a comparing step at which the angle of rotation of the agitating wheel 5 is compared with the preset value N in order to determine if the former reaches the latter, step 109 is a stopping discriminating step at which it is determined that pulse signals from the rotational angle detector 8 are terminated and hence the agitating wheel 5 is stopped, and step 110 is a rotational direction setting step at which a direction of rotation of the motor is set. Reference numerals 122 and 123 designate angle comparing steps at which an angle of rotation before the agitating wheel 5 is stopped is compared with a reference angle of rotation. Further, reference numerals 124, 125 and 126 designate each an operating step at which the reference angle is added to or subtracted from the angle of rotation of the agitating wheel 5, and a result of any such operation is placed into the X register so as to control energization of the motor 11 to coincide the angle of rotation with the reference angle or rotation.

Upon starting a washing operation, articles to be washed, water and a cleanser are charged into the washing tank 2, and the power switch 19 is switched on. Then, at step 100, the flag F is set to 1 for clockwise rotation of the motor 11, and at step 101, the number N of pulses corresponding to a reference angle of rotation of the agitating wheel 5. The value X is stored in the X register at step 102. At step 103, it is determined if the motor 11 is to rotate in the clockwise or counterclockwise direction of $F=1$ here, it is determined that the motor 11 is to rotate in the clockwise direction. As a result, at subsequent step 104, the motor 11 thus begins to rotate in the clockwise direction. The pulley 6 is thus rotated by the motor 11 to rotate the agitating wheel 5 whereupon a pulse signal is produced from the rotational angle detector 8. At next step 106, the pulse is counted by the counter, and the count is put into the T register. At step 107, the contents of the T register and the X register are compared with each other, and if $T<X$, then control goes back to step 103 to continue the clockwise rotation of the motor 11. On the contrary, if $T>X$, that is, when the angle of clockwise rotation of the agitating wheel 5 comes equal to or exceeds beyond the reference angle of rotation, control advances to step 108 at which the motor 11 is deenergized. The motor 11 thereafter continues its clockwise rotation due to its inertia, and meanwhile at step 120, pulse signals are further counted and the count is put into the T register. At step 109, it is determined from the presence or absence of pulse signals if the agitating wheel 5 is actually stopped or not, and when the agitating wheel 5 is not yet in a stopped condition, then control goes back to step 120 to continue a counting operation of such pulse signals. When it is determined that the agitating wheel 5 is in a stopped condition, then zero is put into the X register at step 121. At next step 122, the pulse number N representative of the reference angle of rotation which is preset at step 101 and the pulse number T representative of the angle of actual rotation are compared with each other, and when $T>N$, control goes to step 124 which is an operation processing step at which the number of pulses $(T-N)$ corresponding to an angle by which the actual angle of rotation exceeds the reference angle is calculated, and a value of the reference rotational angle pulse number N less $(T-N)$ is put into the A register. On the other hand, when $T=N$, then control goes from step 123 to step 126 at which the pulse number N is placed into the X register. Further, if $T<N$ from some reason, then control goes from step 123 to step 125 at which a shortage pulse number $(N-T)$ is calculated, and the value $(N-T)$ added by the pulse number N is placed into the X register. Then, at next step 110, it is determined that $F=1$, and accordingly control goes to step 111 at which the rotational direction flag F for the motor 11 is reset to zero. Then at next step 113, the T register is also reset, and control goes back to step 113. Since $F=0$ now, control advances from step 103 to step 105 at which the opposite counterclockwise rotation of the motor 11 is started to rotate the agitating wheel 5 in the counterclockwise direction. The program will thereafter proceed in a similar manner as for the clockwise rotation of the motor 11. As a result, the agitating wheel 5 repeats reciprocal rotations until the power switch 19 is switched off to complete washing of the articles to be washed.

Thus, in the present embodiment, a surplus or deficit of an angle of actual rotation relative to a reference angle of rotation of the agitating wheel 5 in a rotation in one of clockwise and counterclockwise directions is compensated in a rotation of the same in the other direction, as described above. As a result, angles of reciprocal rotation of the agitating wheel 5 in opposite directions are held substantially uniform, thereby eliminating irregular washing performances to improve reliability of washing performances of a washing machine.

Figure 6:
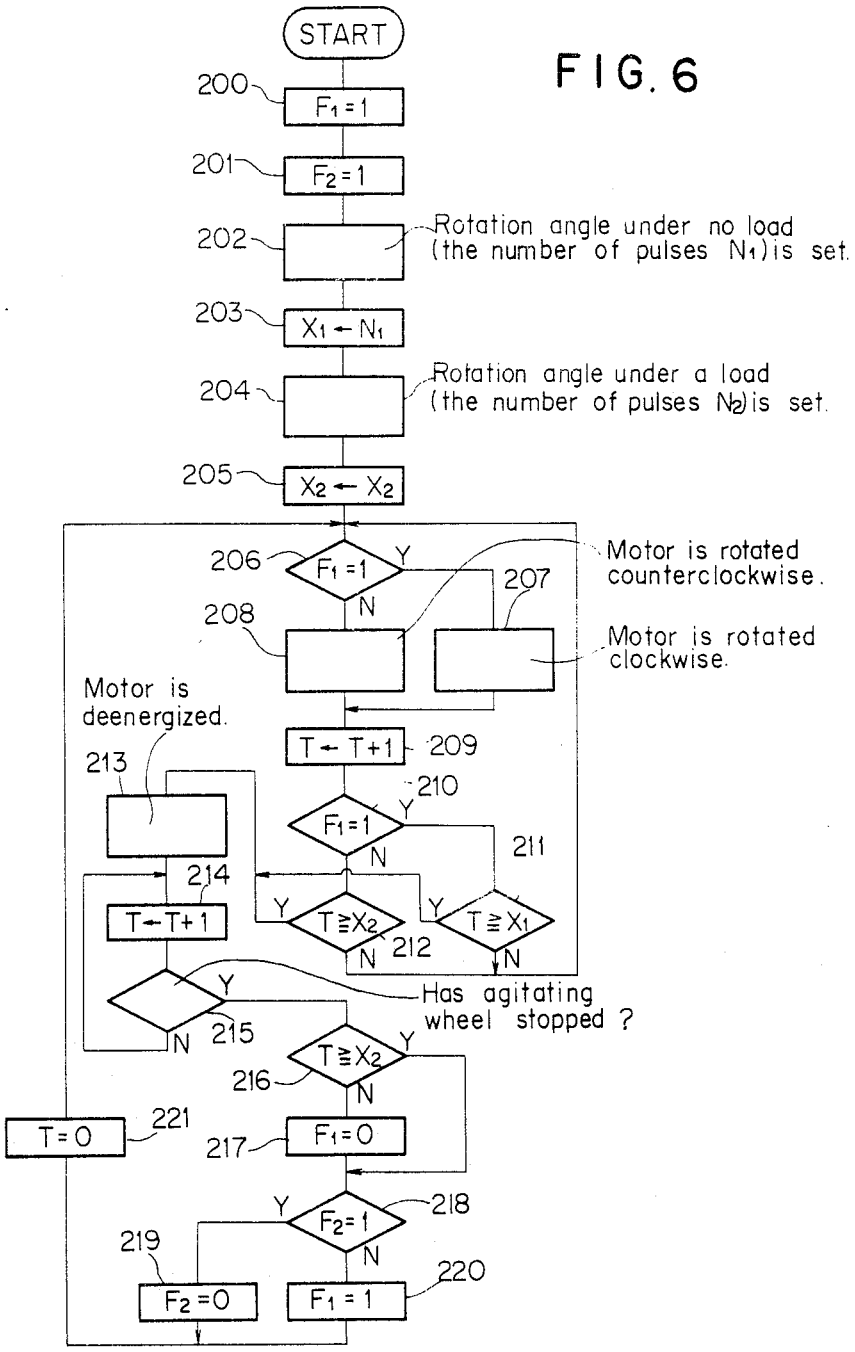
FIG. 6 is a flow chart showing another operation of the control system of FIG. 3.

FIG. 6 is a flow chart showing a further embodiment of the present invention in which an angle of rotation of the agitating wheel during no load running of the machine is smaller than that during running under a load, and changing over between no load running and running under a load is effected automatically in response to a detection signal as described above. In the embodiment, the motor is reversed after the agitating wheel has stopped, an angle or rotation of the agitating wheel is held in any case less than 360 degrees including rotation by inertia, and a period of time required for a reciprocal motion of the agitating wheel is changed in accordance with the amount of articles to be washed, utilizing a difference in rotation by inertia.

Referring to FIG. 6, step 200 is a step at which a no load running flag is set in order that a washing running may be effected by all means under no load to enable detection of a load to be effected upon starting of running of the machine. Step 201 is a step at which a rotational direction flag for the motor 11 is set. Step 202 is a step for setting an angle of rotation of the agitating wheel for no load running (running in a condition in which there is no water nor any article in the washing tank 2), and thus at step 202, the number of pulses $N_1$ is set corresponding to an angle of rotation of the agitating wheel. Then at next step 203, the value $N_1$ is placed into the register $X_1$. Step 204 is a step for setting an angle of rotation of the agitating wheel during running under a load, and at step 204, the number of pulses $N_2$ is set, which value is inputted, at step 205, into a register $X_2$ in a similar manner as in the case of no load running. Step 206 is a step at which a direction of rotation of the motor 11 is changed over. Step 209 is a counter step at which an angle of rotation of the agitating wheel 5 (the number of pulses) upon energization of the motor 11 is counted, and at step 214, an angle of rotation of the agitating wheel 5 is counted while the agitating wheel 5 rotates by its own inertia after the motor 11 has been deenergized, such counts being placed into the T register; a sum total of both counts represents an angle or actual rotation of the agitating wheel 5. Step 210 is a load changing over step at which at an angle of rotation of the agitating wheel 5 (duration of energization of the motor 11) is changed over between for no load running and for running under a load, and at steps 211 and 212, angles of rotation are compared. Step 215 is a stopping discriminating step at which it is discriminated that the agitating wheel 5 has been stopped upon the basis of the fact that there is no pulse signal received from the rotational angle detector 8, and step 218 is a step at which a direction of rotation of the motor 11 is set. The no load running rotational angle set value $N_1$ and the load running rotational angle set value $N_2$ have a relation $N_1<N_2$, and the set value $N_1$ is determined such that the angle of rotation of the agitating wheel 5 including rotation by inertia upon no load running is smaller than 360 degrees and is greater than an angle of rotation corresponding to the rotation angle set value $N_2$ including the rotation angle of the agitating wheel 5 by inertia and on the other hand, the set value $N_1$ is determined such that it is smaller than the angle of rotation corresponding to the set value $N_2$ including the angle of rotation of the agitating wheel 5 including rotation by inertia upon running under a load. Further, the set value $N_2$ is determined such that the angle of rotation of the agitating wheel 5 including rotation by inertia upon running under a load does not exceed 360 degrees.

Now, operations of the apparatus as described just above will be described. At first, articles to be washed, water and a cleanser are put into the washing tank 2 and the power switch 19 is switched on. Then, at step 200, the no load running flag $F_1$ is set to 1, and at step 201, the running direction flag $F_2$ is set to 1 (for clockwise rotation). At step 202, the no load running rotational angle $N_1$ of the agitating wheel 5 (duration of energization of the motor 11) is set, and at step 203, the value $N_1$ is put into the register $X_1$. At next step 204, the load running rotational angle $N_2$ (duration of motor energization) is set, and at step 205, the value $N_2$ is put into the register $X_2$, thus completing initialization of the system.

Then, control goes to step 206, at which $F_2=1$ is determined so that control further goes to step 207 at which the motor 11 is rotated in the clockwise direction to rotate the agitating wheel 5 clockwise, thus starting a washing operation. At the same time at step 209, an angle of rotation of the agitating wheel 5 is detected by means of the rotational angle detector 8 and a pulse signal is added to the register T from the detector 8. At the load changing over step 210, $F=1$ is determined, and hence, control goes to the no load running rotational angle discriminating step 211 at which the count of the register T is compared with the count of the register $X_1$. Here, when $T<X_1$, that is, when the agitating wheel 5 does not yet reach the preset angle, control goes back to step 206 to continue the clockwise rotation of the motor 11. On the contrary, when $T \geqq X_1$, that is, when the agitating wheel 5 reaches the preset angle, control goes to step 213 at which the motor 11 is deenergized. As a result, the agitating wheel 5 enters rotation by inertia while an angle over which the agitating wheel 5 further rotates is added to the register T at step 214. Such counting is continued until the agitating wheel 5 is stopped. The angle of rotation of the agitating wheel 5 by inertia is large when there are a small amount of articles to be washed, and on the contrary when there are a large amount of articles to be washed, it is small. Thus, the angle of rotation of the agitating wheel 5 varies substantially in proportional relationship to the amount of articles to be washed, and as a result, the number of reciprocal motions of the agitating wheel 5 per minute varies automatically.

Then at next stopping discriminating step 215, it is confirmed that the agitating wheel 5 has been stopped upon the basis of the fact that there is no more pulse signal received from the rotational angle detector 8, and at step 216, a load condition is determined. Since now a washing operation is proceeding and the machine is actually under a load, an angle of rotation by inertia is relatively small and thus $T<X_2$. As a result, it is determined that the machine is running under a load (that is, during washing) at step 216, and at next step 217, the flag $F_1$ is reset to zero. Since $F_2=1$ at subsequent motor rotational direction setting step 218, control goes to step 219 at which the flag $F_2$ is reset to zero, and at step 221, the register T is cleared $T=0$ whereafter control goes back to step 206. Since now $F_2=0$ at step 206, control goes to step 208 at which the motor 11 begins its counterclockwise rotation to rotate the agitating wheel 5 in the counterclockwise direction. At step 209, the number of pulses corresponding to an angle of rotation of the agitating wheel 5 is put into the register T, and then, since $F_1=0$ at next step 210, control goes to step 212 at which, since the washing machine is now under a load, the machine is rotated over a greater angle then during no load running. The program will thereafter proceed in a similar manner as for the clockwise rotation of the machine. Thus, the agitating wheel 5 will repeat its reciprocal motions to continue its washing operations until the power switch 15 is switched off.

Thus, the washing machine positively utilizes rotation by inertia of an agitating wheel such that the agitating wheel is rotated in a reverse direction after rotation thereof in one direction has been stopped and, in consideration of a difference in rotation by inertia depending upon an amount of articles to be washed, a period of time for a reciprocal motion of the agitating wheel is changed in accordance with an amount of articles to be washed so as to cause water flows appropriate for the amount of such articles to be automatically produced, thereby preventing damage to cloths of such articles. Further, an angle of rotation of the agitating wheel or duration of energization of a motor during no load running in which relatively large rotation by inertia is involved is made smaller than that during running under a load while changing over between no load running and running under a load is automatically effected in response to a detection signal from a rotational angle detector, whereby an angle of actual rotation of the agitating wheel can be controlled less than 360 degrees. Accordingly, a hand of a man or the like can be prevented from being caught by the agitating wheel and articles being washed are prevented from being entangled with each other. In this way, a washing machine of a high safety and of a high quality can be provided.

Now, description will be given of another example of detecting means which can be applied to the present invention.

Figure 7:
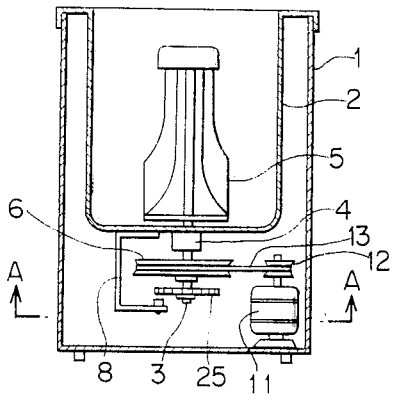
FIG. 7 is a sectional view showing another embodiment of the washing machine.
Figure 8:
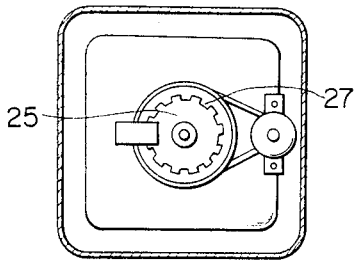
FIG. 8 is a sectional view taken along the line A—A of FIG. 7.
Figure 9:
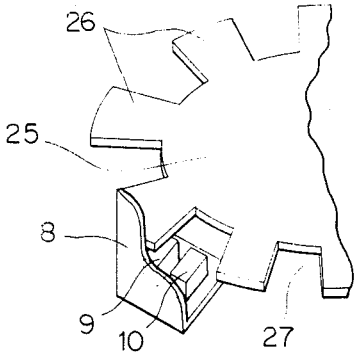
FIG. 9 is an enlarged partially cutaway perspective view showing a rotation angle detector.

While an example is shown in FIGS. 1 and 2 in which the pulley 6 has a plurality of holes 7 perforated therein for detection of an angle of rotation and is interposed between the light emitting means 9 above and the light receiving means 10 below, alternatively an independent detection disk 25 may be provided at an end portion of the main shaft 3, as shown in FIGS. 7 to 9.

Referring to FIGS. 7 to 9, the detection disk 25 is made of a magnetic material such as iron which has alternate teeth 26 and recesses 27 formed in a predetermined spaced relationship around an outer periphery thereof for detecting an angle of rotation of the agitating wheel 5. The detection disk 25 is secured to the main shaft 3. Reference numeral 8 designates an angle detector which includes a magnetic resistor element 9 and a permanent magnet 10 fixedly disposed in a spaced relationship by a predetermined distance from each other and also from a radial end of the detection disk 25. A predetermined voltage is applied to the magnetic resistor element 9. As commonly known in the art, the magnetic resistor element 9 has an electric resistance which varies in response to the intensity of a magnetic field, and the direction of a magnetic field varies in response to presence and absence of a recess 27 of the disk 25. As a result, as the detection disk 25 which is a magnetic member is rotated, an electric current flowing through the magnetic resistor element 9 varies each time as recess 27 passes thereby. In the present arrangement, the electic current is processed electrically such that, as the detection disk 25 is rotated, pulse-like electric signals corresponding to an angle of actual rotation of the agitating wheel 5 are detected.

Figure 10:
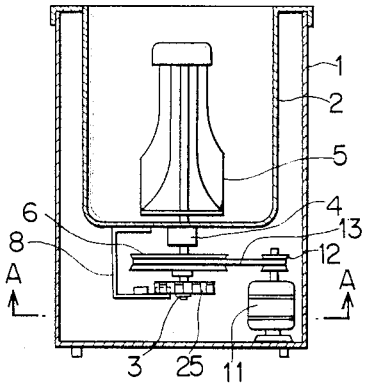
FIG. 10 is a sectional view showing a further embodiment of the washing machine.
Figure 11:
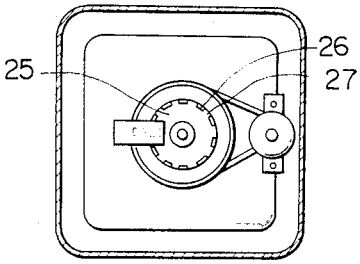
FIG. 11 is a sectional view taken along the line A—A of FIG. 10.
Figure 12:
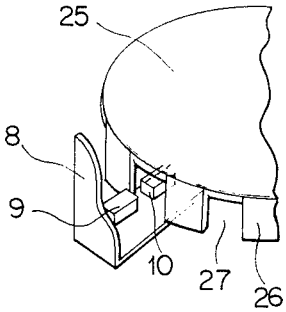
FIG. 12 is a perspective view showing another embodiment of a rotation angle detector.

Reference is now made to FIGS. 10 to 12 which shows a further example of detecting means. The detecting means includes a similar detection disk 25 to that of FIGS. 7 to 9, but this detection disk 25 has a side wall section 26 integrally formed to extend substantially perpendicularly in a downward direction from an outer circumferential end thereof. The side wall section 26 of the detection disk 25 has a plurality of detection recesses 27 formed in a circumferentially equally spaced relationship therein to provide a comb-like configuration to the side wall section 26. Reference numeral 8 denotes a rotational angle detector mounted on the bottom of the washing tank 2 and including a light emitting element 9 and a light receiving element 10 disposed in opposing relationship adjacent opposite sides of the side wall section 26. Thus, when a detection recess 27 is positioned between the light emitting element 9 and the light receiving element 10, light from the light emitting element 9 is received by the light receiving element 10. On the contrary, when a portion of the side wall section 26 other than the detection recesses 27 is positioned between the light emitting element 9 and the light receiving element 10, light from the light emitting element 9 is interrupted thereby. Accordingly, pulse signals which correspond to an angle of rotation of the agitating wheel 5 are outputted from the light receiving element 10.

It is to be noted that the rotational angle detector 8 of the example described just above may alternatively be constituted such that the detection disk 25 is made of a magnetic material such as, for example, iron and the light emitting element 9 and the light receiving element 10 are replaced by a Hall element and a permanent magnet, respectively. In particular, a predetermined voltage is applied to the Hall element 9, and as commonly known in the art, an electric current flowing through the Hall element 9 varies in response to the intensity of a magnetic field due to a Hall effect, and the direction of a magnetic field varies in response to presence and absence of a recess 27 of the disk 25. As a result, as the detection disk 25 which is a magnetic member is rotated, an electric current flowing through the Hall element 9 varies each time a recess 27 passes thereby. The electric current is processed electrically such that, as the detection disk 25 is rotated to rotate the side wall 26, pulse-like electric signals corresponding to an angle of actual rotation of the agitating wheel 5 are detected.

It is to be mentioned that an angle of rotation can be detected similarly if the Hall element is otherwise replaced by a magnetic resistor element which has an electric resistance which varies in response to the intensity of a magnetic field.

Figure 13:
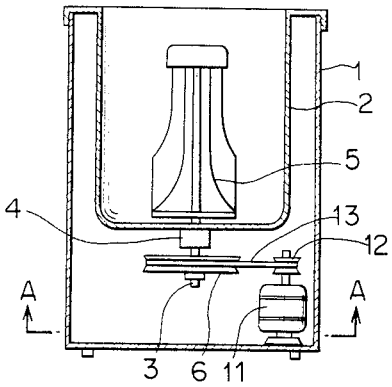
FIG. 13 is a sectional view similar to FIG. 11.
Figure 14:
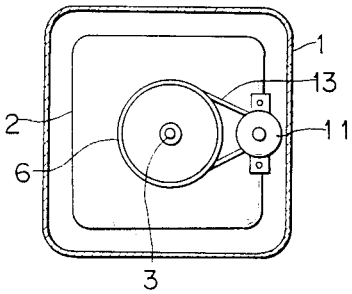
FIG. 14 is a sectional view taken along the line A—A of FIG. 13.
Figure 15:
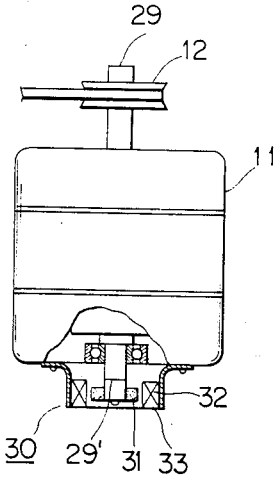
FIG. 15 is an enlarged partially cutaway view showing a rotation angle detector secured to the motor shaft.

It is also to be mentioned that, while only the examples of detecting means which involve detection of an angle of rotation of the agitating wheel 5, an angle of rotation of the agitating wheel can otherwise be detected indirectly from detection of the number of rotations of the agitating wheel. Such an example is illustrated in FIGS. 13 to 15. In this arrangment, a reduction ratio which is determined by a pulley 6 and a motor pulley 12 is almost 10:1 so that one complete rotation of a motor will rotate an agitating wheel 5 by an angle of about 36 degrees.

In the arrangment of FIGS. 13 to 15, a motor 11 having high rigidity has a rotation detector 30 disposed therefor for detecting the number of rotations of the motor. The rotation detector 30 includes a cylindrical permanent magnet 31 fixedly mounted on a lower end 29' of a motor shaft 29, a generating coil 32 wound in a cylindrical form around an outer periphery of the permanent magnet 31 with a predetermined air gap left therebetween, and a magnetic shield member 33 disposed in the air gap between the permanent magnet 31 and the generating coil 32 to partially interrupt a magnetic field of the permanent magnet 31. Since, in the rotation detector 30 having such a construction as described above, rotation of the motor shaft 29 will rotate the permanent magnet 31 fixedly mounted thereon, a sinusoidal electric current is induced in the generating coil 32 in synchronized relationship to rotation of the permanent magnet 31, as commonly known in the art. The sinusoidal electric current is processed electrically so that, as the motor 11 rotates, pulse-like electric signals are outputted in synchronism therewith. In this way, the rotation detector 30 is disposed in the motor 11 in which most parts are made of metal materials so that rotational conditions of the motor can be detected directly. This construction thus assures high accuracy in assembly and high workability and enables accurate and stabilized detection of rotational conditions of a motor.

What is claimed is:

1. An agitating type washing machine in which a washing drive motor is run in opposite directions to rotate an agitating wheel within a washing tank alternatively in one and the other directions to perform intended washing, comprising rotational angle detecting means for detecting an angle of rotation of said agitating wheel, and control means for controlling said motor in response to a detection signal from said rotational angle detecting means so that the angle of rotation of said agitating wheel by energization of said motor during running under a load is made smaller than the angle of rotation during no load running and so that changing over between running under a load and no load running is automatically effected in response to a detection signal from said rotational angle detecting means, said control means further controlling rotation of said agitating wheel to an angle equal to or less than 360 degrees including rotation by energization of said motor and rotation by inertia whether during running under a load or no load.

2. An agitating type washing machine according to claim 1, in which said control means automatically changes over between no load running and running under a load and changes the period of time required for a reciprocal motion of the agitating wheel in accordance with the amount of articles to be washed, by utilizing a difference in rotation by inertia.

3. An agitating type washing machine according to claim 1, in which said control means changes over between the rotation angles of the agitating wheel by energization of said motor under a load and no load running to control the motor so that the reciprocal rotation angle is kept substantially constant whether during running under a load or no load and independently of the amount of the load.

4. An agitating type washing machine according to any one of claims 1 to 3, in which said rotational angle detecting means detects the number of rotations of the motor for driving the washing machine.

* * * * *

UNITED STATES PATENT AND TRADEMARK OFFICE

CERTIFICATE OF CORRECTION

PATENT NO. : 4,554,805

DATED : November 26, 1985

INVENTOR(S) : Hiroshi HIROOKA et al

It is certified that error appears in the above-identified patent and that said Letters Patent is hereby corrected as shown below:

On the cover page, Item [73], "Kaisha, Kentetsuco., Ltd., Tokyo, Japan" should read --Mitsubishi Denki Kabushiki Kaisha, Tokyo, Japan and Nihon Kentetsu Co., Ltd., Tokyo, Japan--.

Signed and Sealed this

*Twenty-sixth* Day of *August 1986*

[SEAL]

*Attest:*

DONALD J. QUIGG

*Attesting Officer*

*Commissioner of Patents and Trademarks*